US008757167B1

(12) United States Patent
Jurczenia et al.

(10) Patent No.: US 8,757,167 B1
(45) Date of Patent: Jun. 24, 2014

(54) PRECISE SNUFF PORTION PACKAGING MACHINE

(75) Inventors: Edward Jurczenia, Greenwich, CT (US); Eugene H. Paules, Huntington, CT (US); Frank S. Nastro, East Kilbride (GB)

(73) Assignee: U.S. Smokeless Tobacco Company LLC, Richmond, VA (US)

( * ) Notice: Subject to any disclaimer, the term of this patent is extended or adjusted under 35 U.S.C. 154(b) by 0 days.

(21) Appl. No.: 07/084,329

(22) Filed: Aug. 11, 1987

Related U.S. Application Data

(63) Continuation-in-part of application No. 06/530,865, filed on Sep. 9, 1983, now Pat. No. 4,703,765.

(51) Int. Cl.
*A24B 1/10* (2006.01)
*B65B 29/00* (2006.01)

(52) U.S. Cl.
USPC ..... 131/112; 131/118; 53/477; 83/350

(58) Field of Classification Search
USPC ..... 131/111, 112, 119, 282, 283, 115, 118; 222/520, 367; 53/450, 452, 455, 456, 53/545, 548, 500, 563, 477; 83/350, 355
See application file for complete search history.

(56) References Cited

U.S. PATENT DOCUMENTS

| | | | | |
|---|---|---|---|---|
| 1,092,232 | A | 4/1914 | Thom | |
| 1,177,066 | A | 3/1916 | Thom | |
| 1,587,478 | A * | 6/1926 | Du Brul et al. | 131/41 |
| 1,986,422 | A * | 1/1935 | Zwoyer | 53/131.5 |
| 2,113,636 | A * | 4/1938 | Vogt | 53/433 |
| 2,533,554 | A * | 12/1950 | Byerly | 206/527 |
| 3,715,059 | A * | 2/1973 | Hyer | 222/199 |
| 4,006,846 | A * | 2/1977 | Coucher | 406/63 |
| 4,524,567 | A * | 6/1985 | Patelli | 53/552 |
| 4,607,479 | A * | 8/1986 | Linden | 53/530 |
| 4,646,933 | A | 3/1987 | Jurczenia et al. | |
| 4,657,622 | A | 4/1987 | Paules | |
| 4,703,765 | A * | 11/1987 | Paules et al. | 131/112 |
| 4,711,687 | A | 12/1987 | Paules | |
| 4,946,723 | A | 8/1990 | Paules et al. | |
| 5,061,334 | A | 10/1991 | Paules | |

FOREIGN PATENT DOCUMENTS

EP 149985 A * 7/1985

OTHER PUBLICATIONS

Definition of Die, Merriam-Webster Dictionary, downloaded online Jan. 19, 2012.*

Definition of sensor, Merriam-Webster Dictionary, downloaded online Jan. 17, 2012.*

* cited by examiner

*Primary Examiner* — Anthony Calandra

(74) *Attorney, Agent, or Firm* — Fish & Richardson P.C.

(57) ABSTRACT

A machine for forming, continuously, distinct portions of particulate matter such as smokeless tobacco, i.e., snuff, in a pouch or pocket form, and continuously forming individual pouches or pockets containing the distinct portions of the particulate matter.

13 Claims, 15 Drawing Sheets

FIG. 9
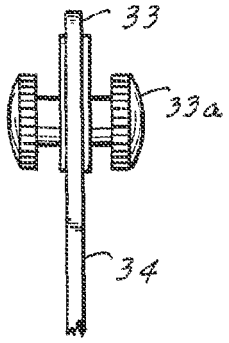
FIG. 10
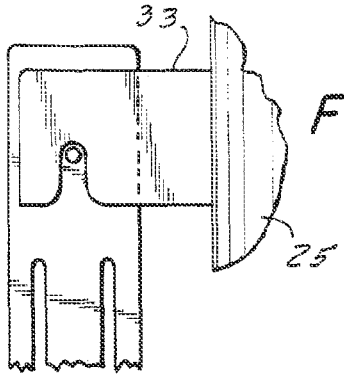
FIG. 7
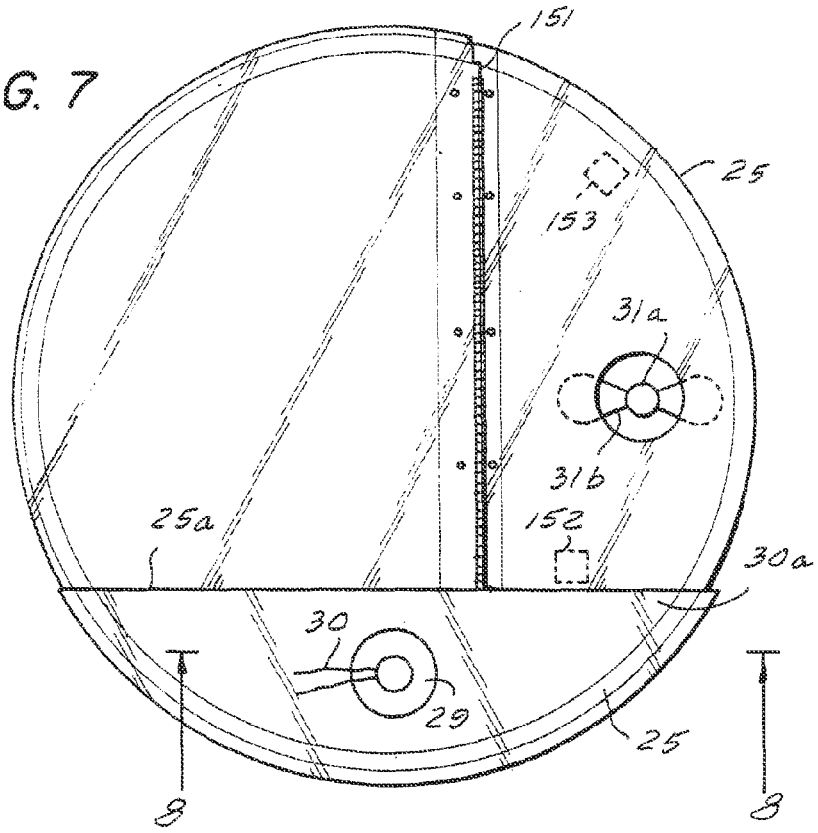
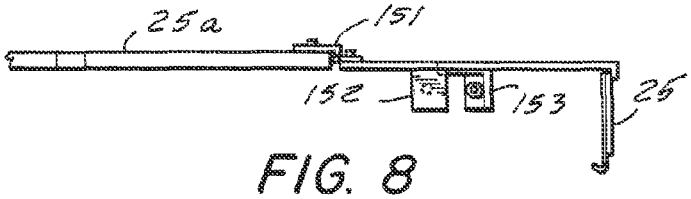
FIG. 8

10d
10d
67
70
69
69a
69b
69c
69d
69e
69f
69g
69h
71a
71b
301
302
303
304
305
306
307
308
309
310

PRECISE SNUFF PORTION PACKAGING MACHINE

This application is a continuation-in-part of application Ser. No. 06/530,865, now allowed and for which a final fee has been paid on Jun. 1, 1987.

This invention pertains to a machine for forming individual packets or pouches of smokeless tobacco, namely—snuff. More particularly, this invention pertains to a machine by which, in a continuous operation at a high production rate and with great reliability, packets are formed with great reliability as to the content of each of the packets upon filling, sealing, and the packaging.

BACKGROUND FOR THE INVENTION

With the ever-increasing use of smokeless tobacco and the advantages of having individual portions prepackaged in a suitable permeable pouch or packet, the individual packaging of these rather small pouches has become extremely difficult on a large scale, rapid production basis. The basic problem has been the inability to form with assured reliability individual packages in a continuous manner at rates of production which would be acceptable based on the demanded quality control and product specifications. As a consequence, prior art machines which have formed individual packets on a step and index basis have had production rates which have been unsatisfactory. Individual packages have varied in quality and content. Unpredictable products and their slow production have been very unacceptable. In part, this has been due to the agglomerative nature of snuff tobacco, all resulting in the production of unacceptable products with a number of quality control problems found to be unmanageable in prior art machines, even at their low rates of production.

BRIEF DESCRIPTION OF THE INVENTION

A machine has now been invented in which a combination of elements are cooperating in a novel manner, employing means heretofore not employed for forming individual portions of the tobacco-containing packets. In this machine, portions of pre-measured amounts are injected from a continuously moving feed wheel, i.e., disc in a continuously formed permeable, non-woven, e.g., paper, tube. While individual filling of the packets takes place, these packets are formed continuously in a string of packets. These packets are appropriately sealed, quality-controlled, and cut while in a continuous motion in individual packets or pouches from a formed string or chain of packets. Thereafter, these are packaged in a pre-set count in packages, i.e, cans, which, in a step and index manner, are filled, moisturized and closed at high production rates.

This outstanding production has been achieved despite the demand for careful, individual packet formation and packaging of a predetermined count in a can. These high production rates heretofore have been incapable of achievement in forming individually packed pouches of smokeless tobacco. Moreover, the combination of continuous tobacco portion formation with a continuous string of packet formation, continuous cutting of a string of packets, and then step and index packaging in a manner as set forth herein, allows achieving the heretofore unheard of production rates. Previous art attempts have been directed to step and index formation of the pouches which has not made possible high production rates.

Whenever the terms pouches or packet or bag have been used, these are meant to signify either particulate matter or tobacco, but preferably a tobacco-containing, permeable, end sealed tube having a discrete portion of tobacco therein. Whenever the terms package, container or can are used, these are meant to signify the container in which the above-mentioned packets are placed at the end of the production cycle.

DETAILED DESCRIPTION OF THE INVENTION AND EMBODIMENTS THEREOF

With reference to the drawings herein which illustrate the present invention and various aspects thereon and wherein:

FIG. 1*a* shows the production sequence for the packet or pouch and its packaging;

Figure 1:
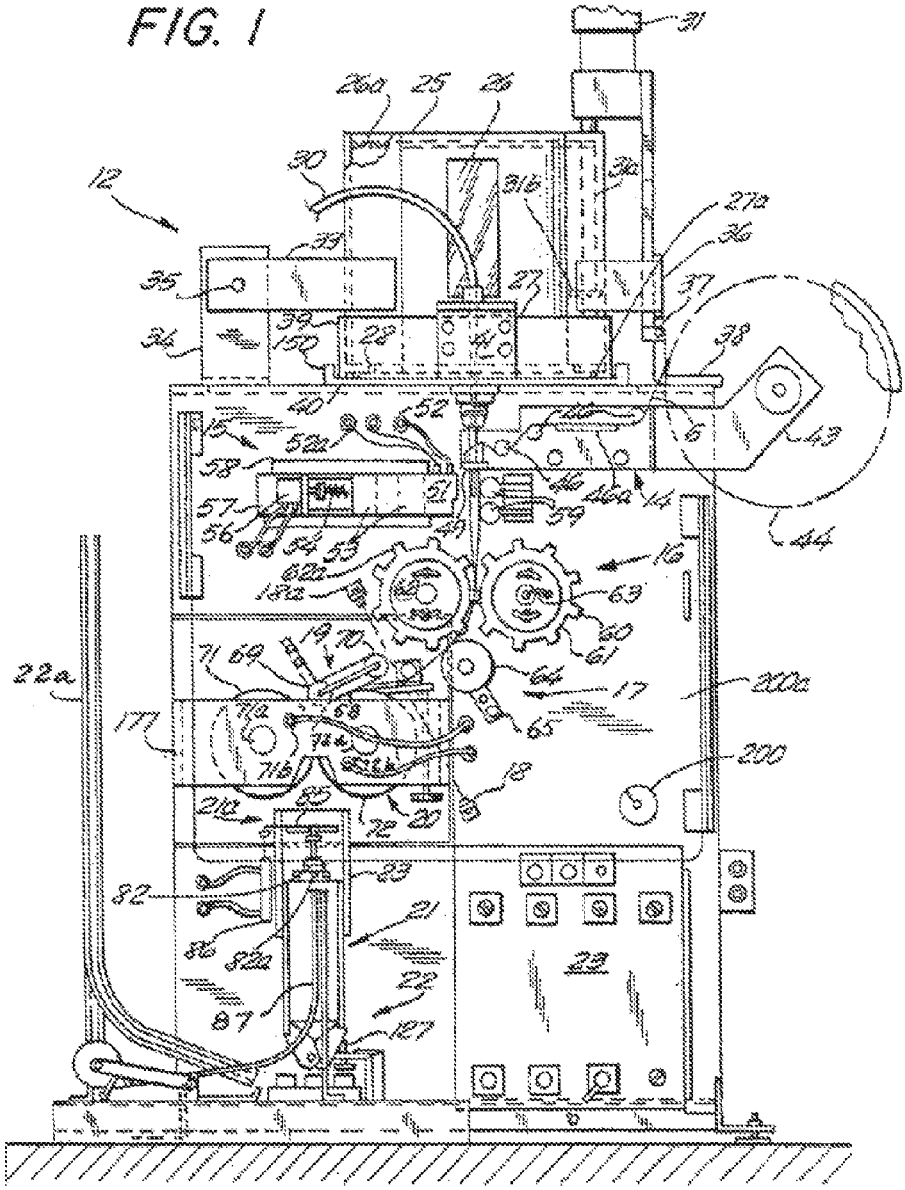
FIG. 1 illustrates the front view of the machine.
Figure 4:
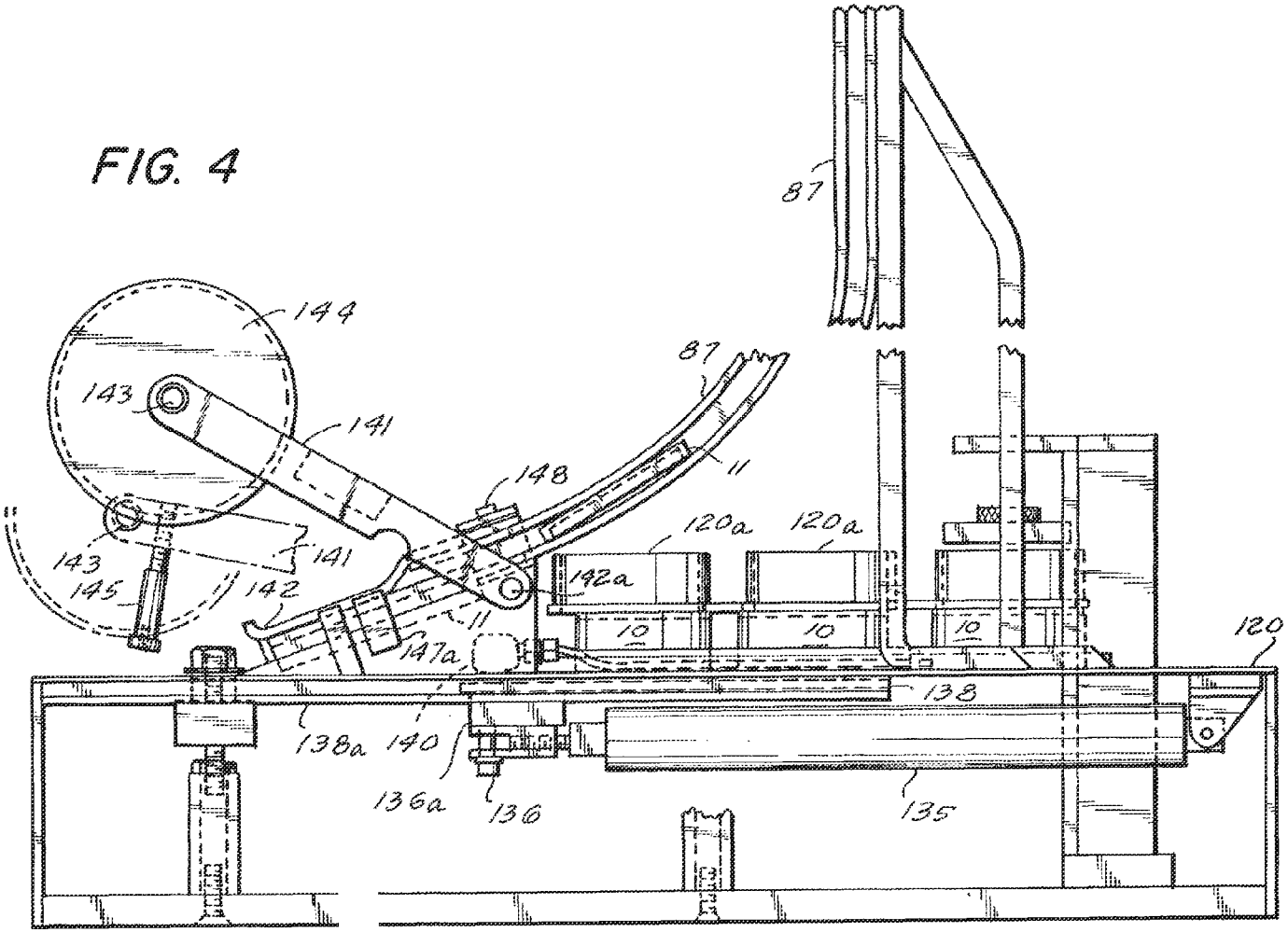
FIG. 4 illustrates in a partial side view the container filling machine with the step and index means for moving a fill table, and in a partial view a lid closing means.
Figure 4A:
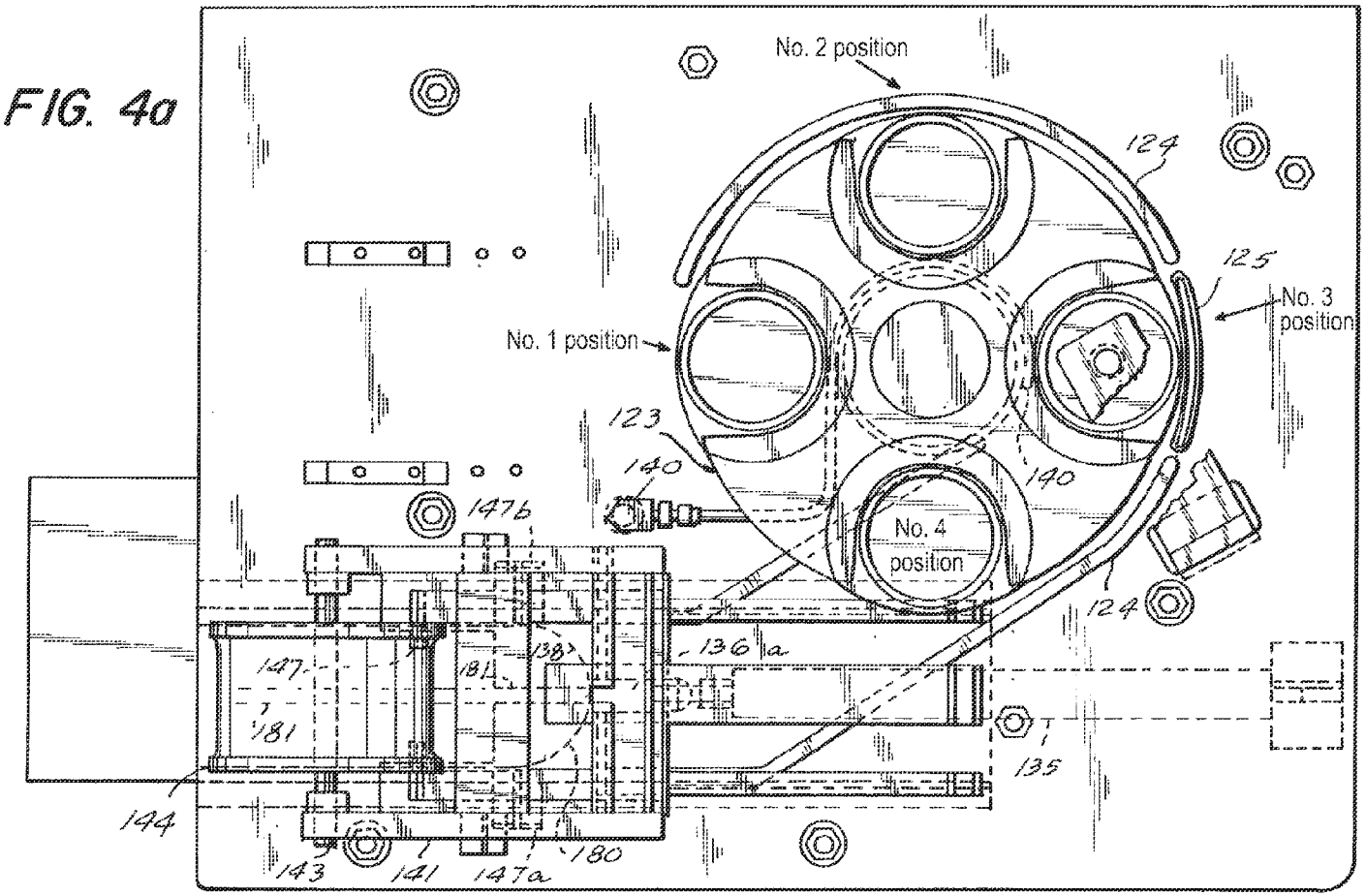
Figure 5:
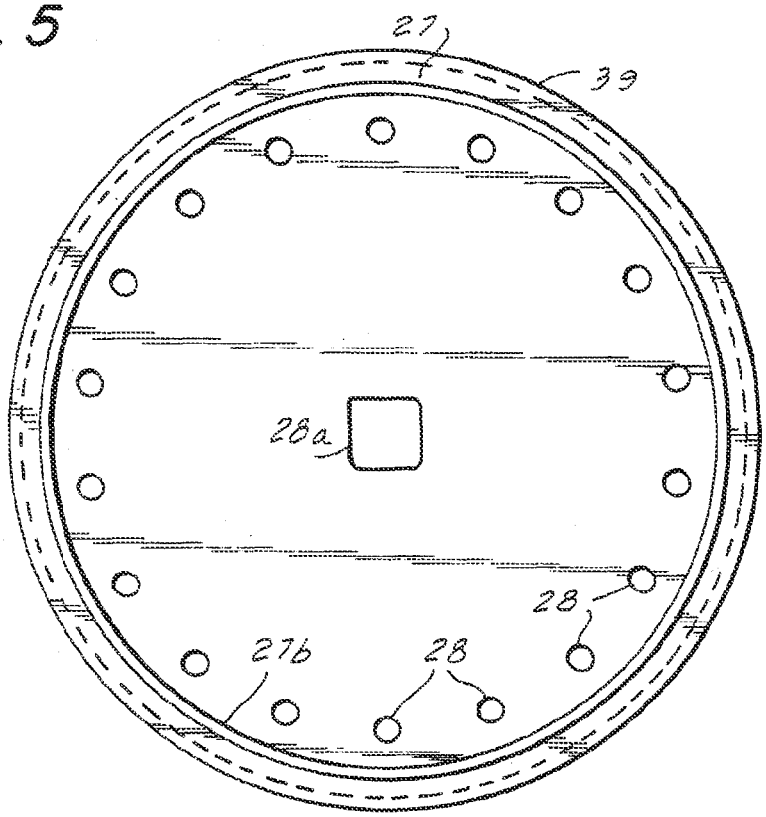
Figure 4B:
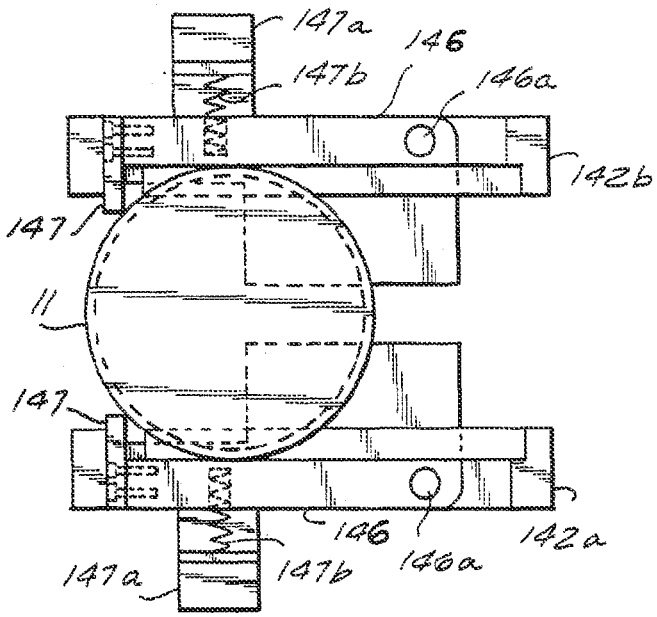
Figure 6:
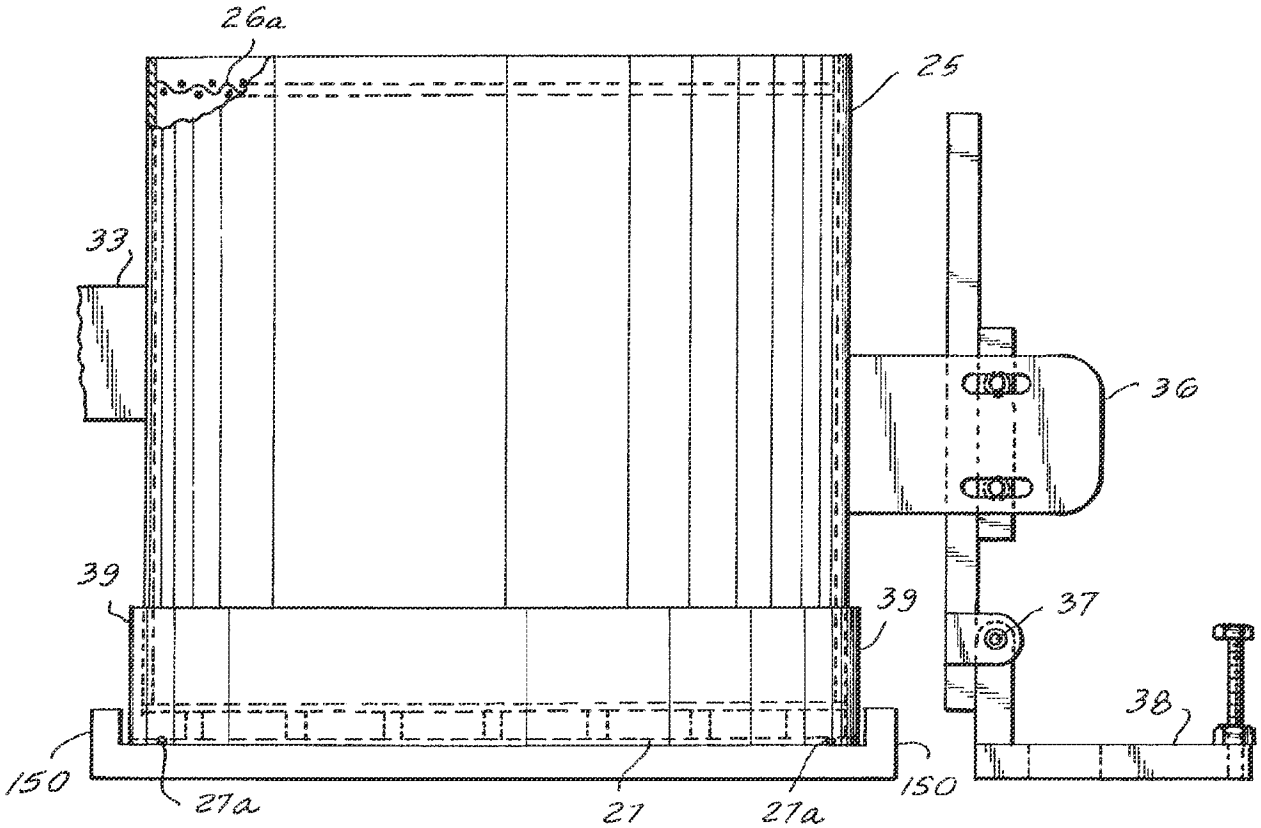
Figure 10A:
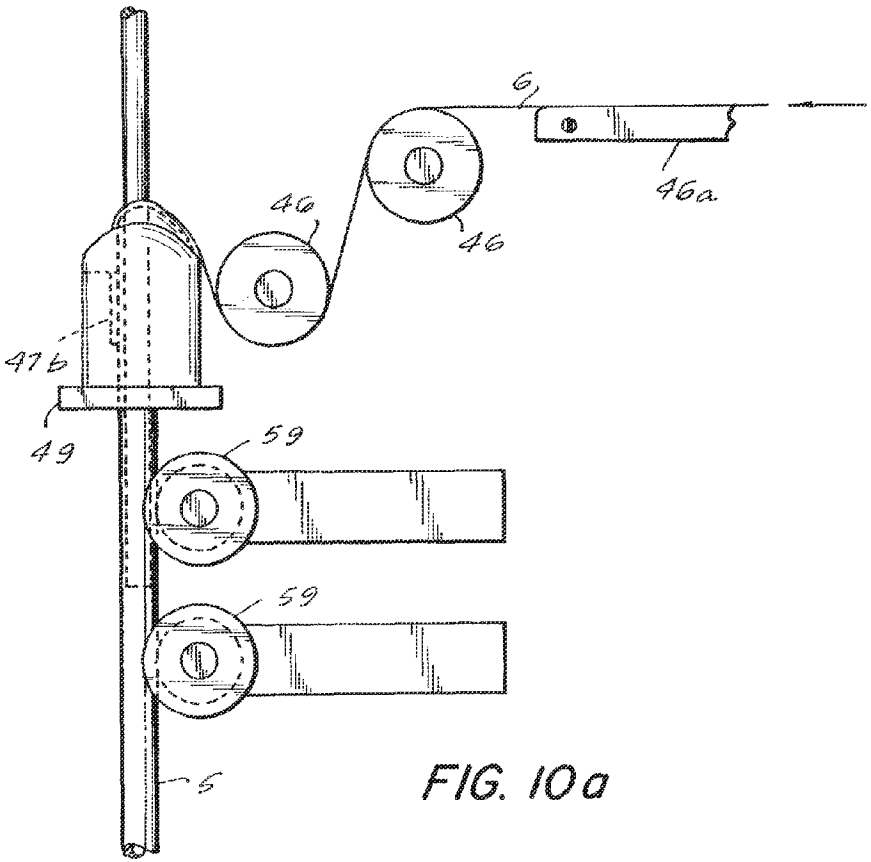
Figure 10B:
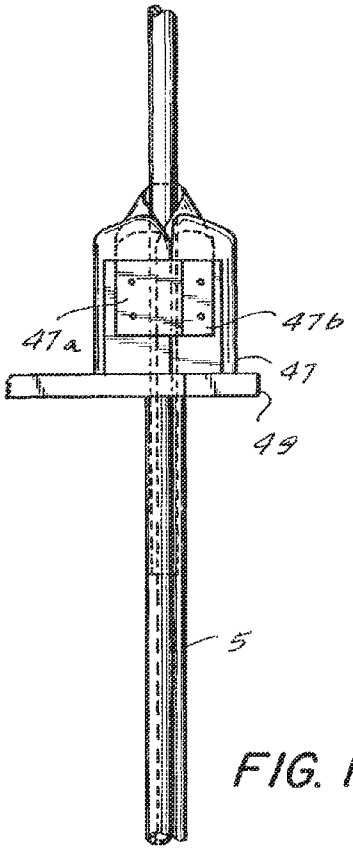
Figures 10C, 10D:
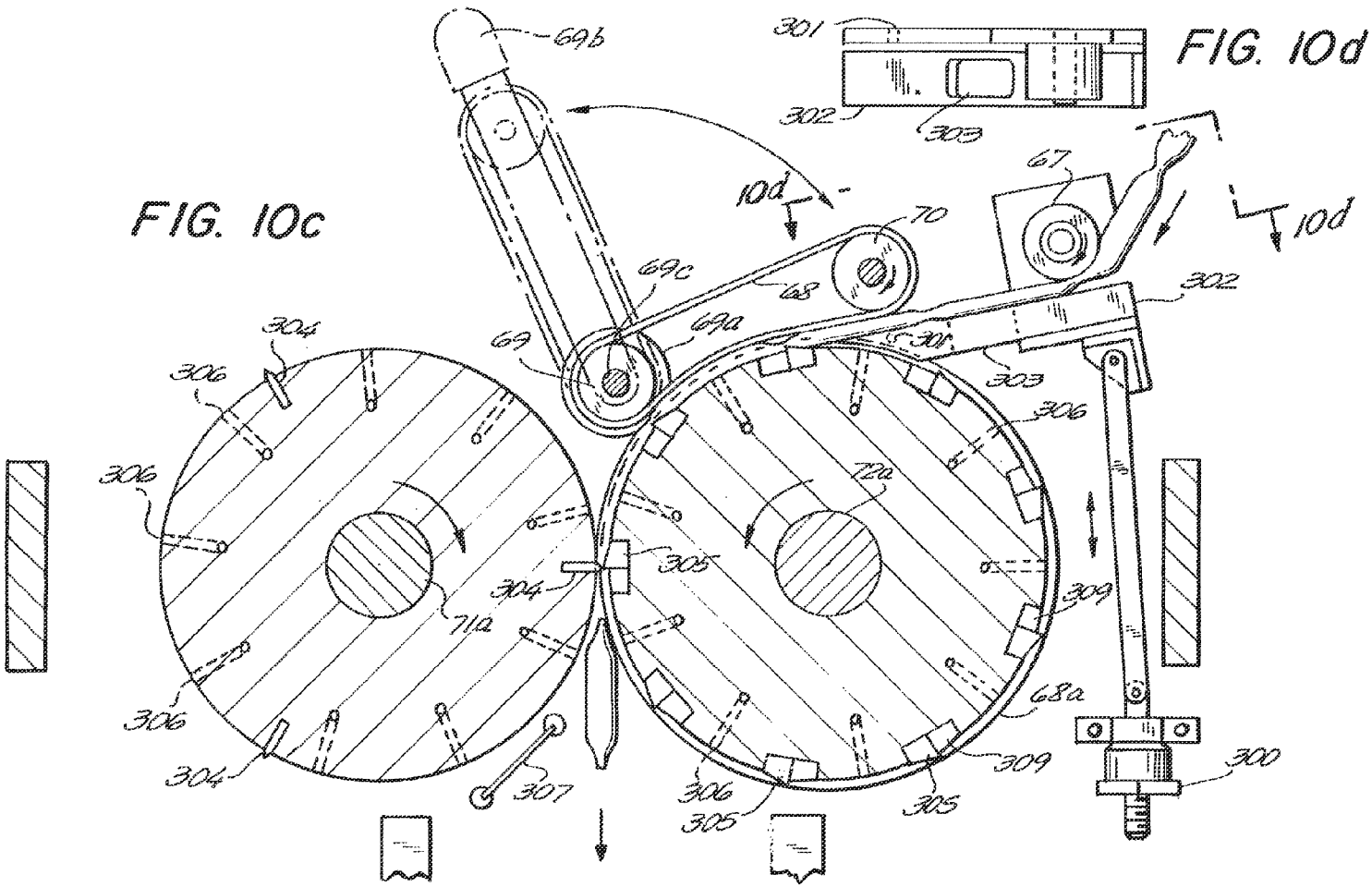
Figure 11:
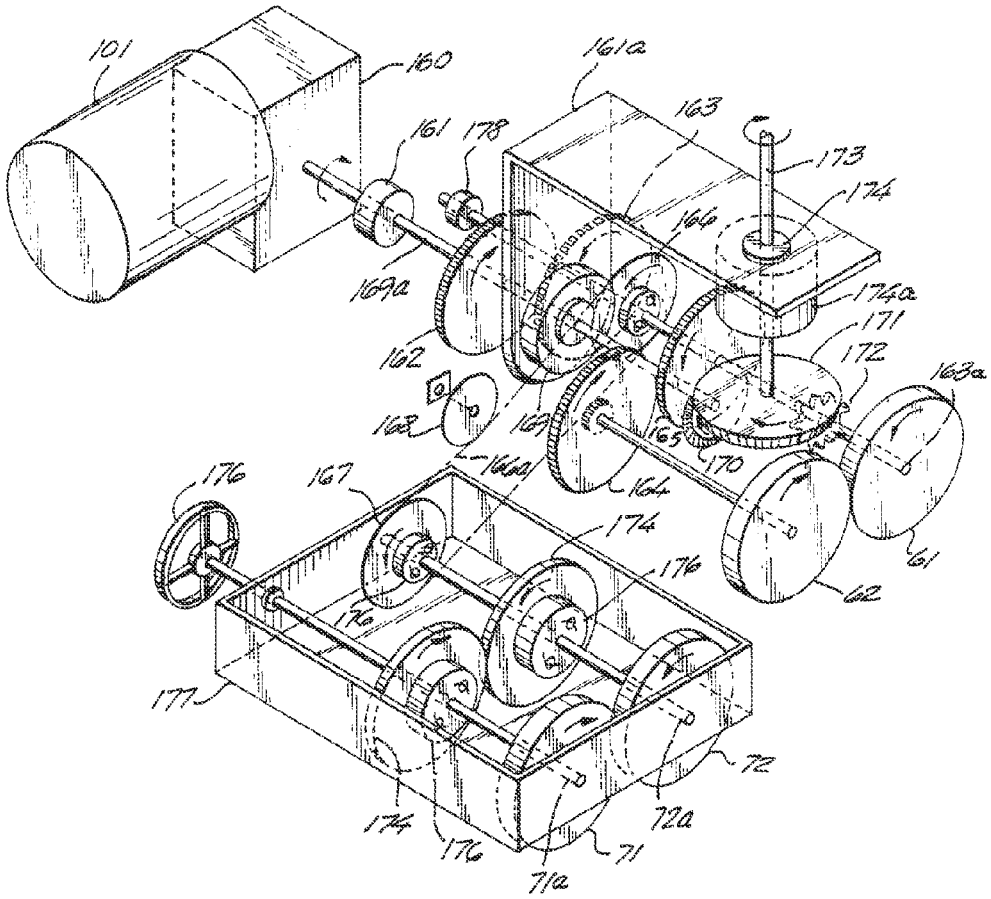
Figure 11A:
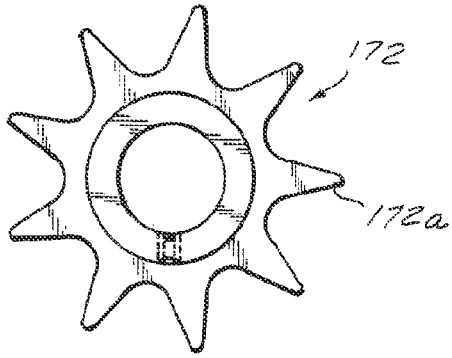
Figure 11C:
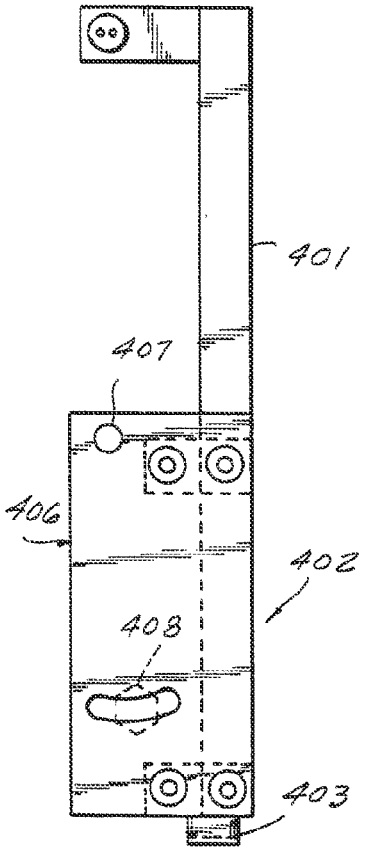
Figure 11B:
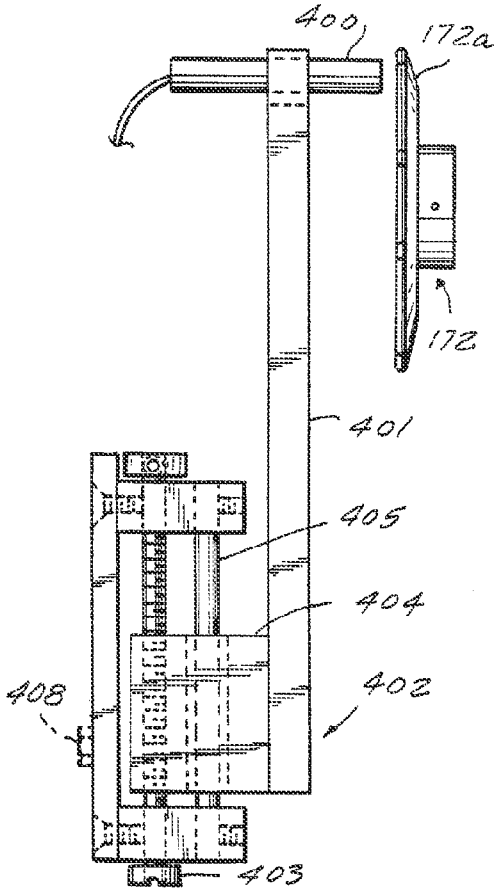

FIG. 4*a* shows in a partial top view the container filling machine and lid closing means shown in FIG. 4;

FIG. 4*b* shows a top view of a detail of a lid feeding mechanism shown in FIG. 4;

FIG. 5 shows a partial bottom view of a continuous feed wheel;

FIG. 6 shows a partial view of a hopper with a feed wheel as shown in FIG. 5 in a phantom side view;

FIG. 7 shows a partial top view of the hopper;

FIG. 8 shows a partial side view of the hopper lid shown in FIG. 7, viewing along line 8-8;

FIG. 9 is a partial latch means for holding down the hopper;

FIG. 10 is a further detail of the latch shown in FIG. 9;

FIG. 10*a* shows the front view of the mechanism for forming a permeable material tape into a continuous tube;

FIG. 10*b* shows the side view of the permeable material tape folding die of FIG. 10*a* for forming the tube which surrounds a filler tube for the formed tube;

FIG. 10*c* shows, in part, a cross-sectional view of the cutting device for cutting off individual packets from the chain of packets previously formed, including associated guide means;

FIG. 10*d* is a top view along lines 10*d* of FIG. 100 of a guide and adjustment means;

FIG. 11 is a drive train for the machine of FIG. 1 in a schematic perspective view illustrating the continuously rotating feed wheel interrelation with the pouch forming section and the pouch cutting section;

FIG. 11*a* is a star wheel shown in FIG. 11;

FIG. 11*b* is a top view of a proximity sensor mechanism used in conjunction with the star wheel;

FIG. 11*c* is a partial side view of the proximity sensor mechanism shown in FIG. 11*b;*

Figure 12:
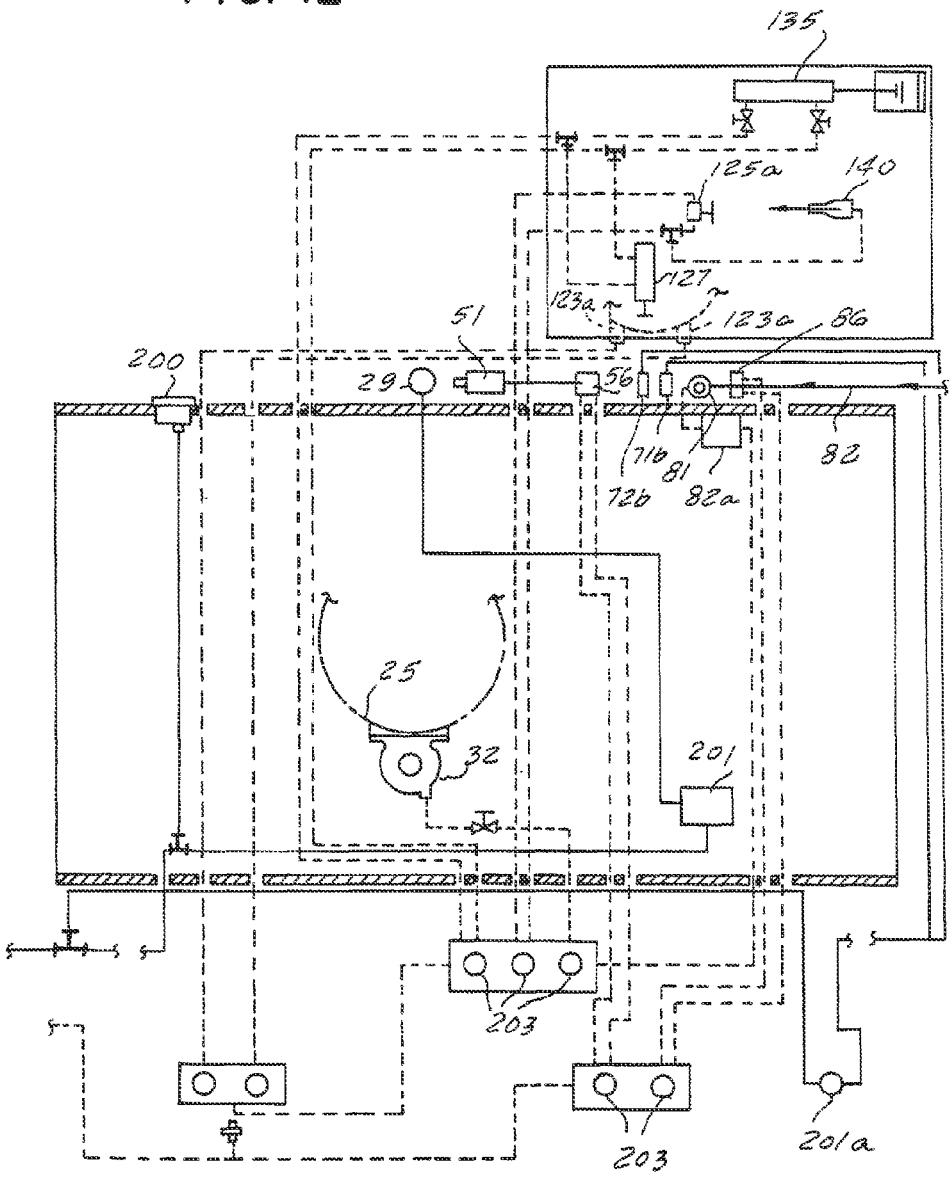

FIG. 12 is a schematically presented pneumatic circuit of the machine, and

Figure 13:
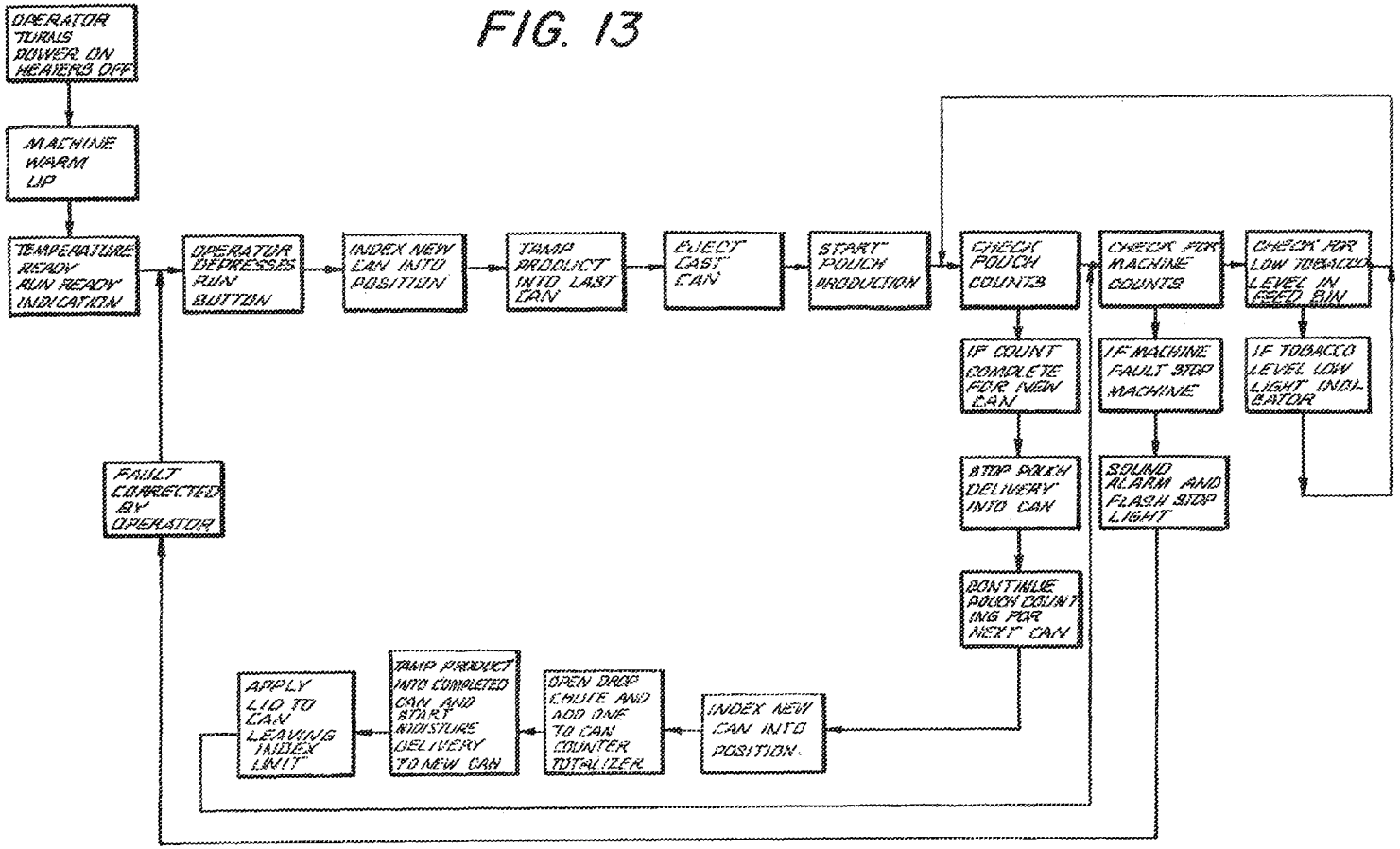

FIG. 13 is a block diagram of the machine operations steps with trouble shooting feed-back operation steps incorporated in the sequence.

Figure 1A:
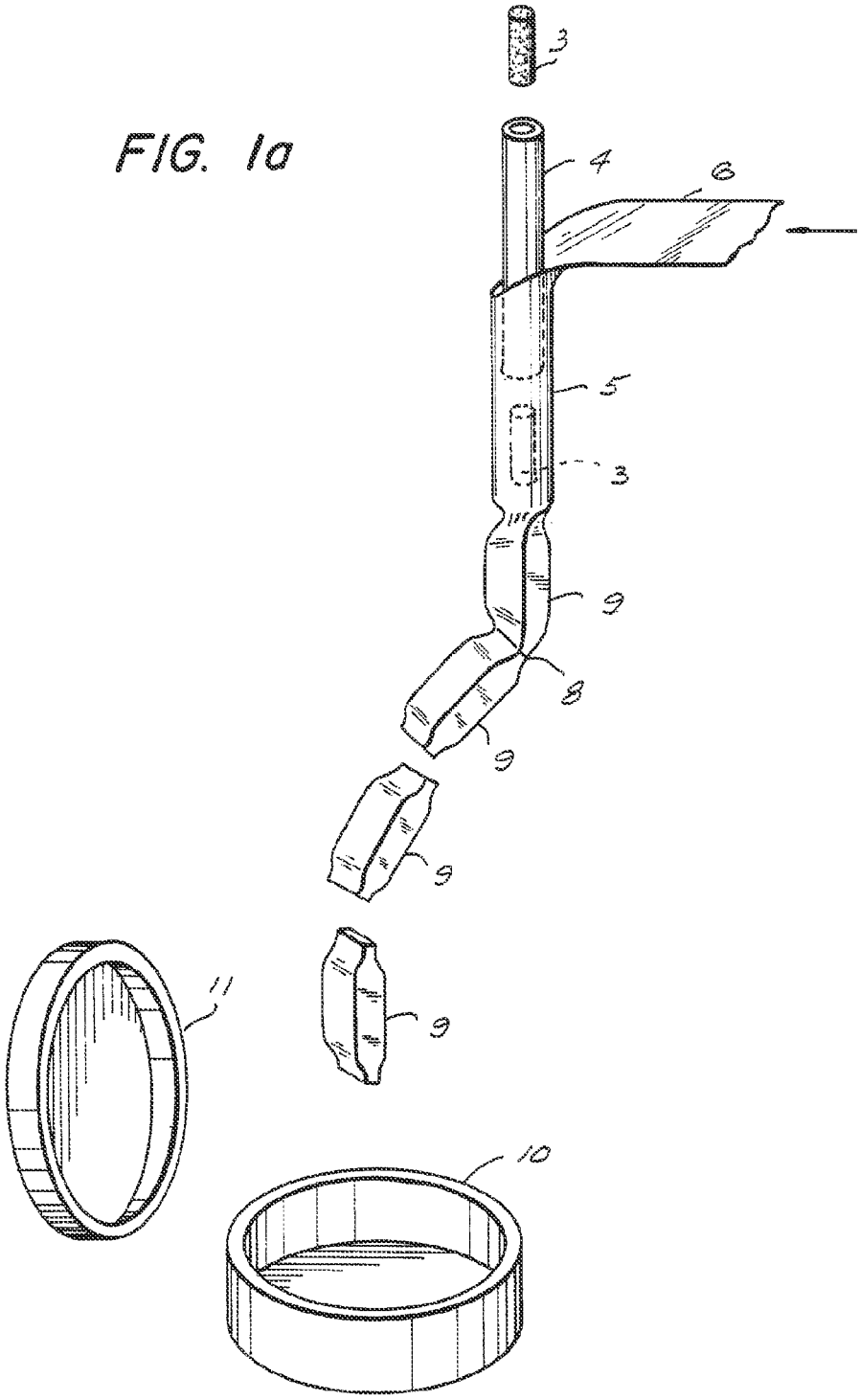

Turning now to the Figure, FIG. 1*a* shows the sequence of forming the individual pouches. In accordance with the Figure, an individual portion of tobacco 3 pneumatically forced through a fill tube 4 is injected in a paper tube 5 formed of a paper tape 6. A transverse seal portion 7 allows the individual portion of tobacco 3 to be placed in the pre-formed, bottom sealed 7 packet, but it is a not as yet completely sealed paper tube. As the tube 5 continuously advances, the preceding seal 8 and the bottom seal 7 form a pouch or packet 9 of a carefully measured portion of tobacco 3 contained therein.

Each of the packets 9 is a link 9 in the chain or string of packets. Each packet 9 is defined by the end seals 7 and 8, and the packet or pouch 9 thus formed is continuously advanced. Individually formed pouches are then severed and counted for packaging a pre-set number of these packets into a package 10. After an appropriate amount of moisture is added to the can and a lid 11 placed thereon for sealing, these cans are ready for distribution and use by the ultimate consumer.

Turning now to FIG. 1 and identifying the individual sections cooperating to achieve the above-described formation of the individual packets 9 and their packaging, the tobacco holding or hopper section has been identified as 12, the section where the paper tape 6 is converted into a continuous tube 5 has been identified as 14, the longitudinal tube sealing unit as 15; the transverse individual packet sealing and pouch-forming unit as 16; the takeoff roller unit for the formed pouch chain is identified as 17; the photoelectric cell and light have been identified as 18 and 18*a*; the packet 9 guide unit has been identified as 19. This unit guides the chain into the cutting unit 20. The individually severed pouches 9 fall into an accumulator unit 21*a*. Moisture is added by means of the unit identified as 21. Thereafter, the correct pouch count containing cane and can lids are joined in unit 22. A guide chute for the lids has been shown as 87 and the cans as 22*a*. A control panel 23 in FIG. 1 contains the operator manipulated controls.

Turning now to FIG. 1 and describing the machine in more detail and beginning with the hopper unit 12, the hopper 25 contains the tobacco for filling the individual packets. The hopper has a fill level window 26 allowing an operator to observe the level of tobacco in the hopper. At the top of the hopper is a screen 26*a*, when needed, the hopper 25 is filled, but the rough or agglomerated pieces are screened out in screen 26*a*. The hopper overlies a feed wheel 27 which is further shown in FIG. 5. Feed wheel 27 contains a number of pre-sized feed holes 28. The feed wheel is about ½ inch thick, but the thickness may vary. As the feed wheel holes 28 are positioned in a continuous rotation, as further explained herein, in alignment with the feed tube 4 and feed nozzle 29, each of the holes 28 in that position contain a portion of tobacco slated for a packet 9. As can be appreciated, these portions, shown as 3 in FIG. 1*a*, may be changed by changing slightly the size of the holes 28.

The feed nozzle 29 is operated by a pneumatic conduit line 30. The pneumatically injected air in feed nozzle 29 pneumatically ejects the tobacco accumulated into holes 28 in the feed wheel 27, as it will be further elaborated herein. In order to assure that each of the holes 28 in the feed wheel 27 are being filled, a vibrator, shown in FIG. 2 as 32, is used to vibrate or agitate the finely cut tobacco in hopper 25.

Further, in order to assure proper alignment of a hole 28 with the feed nozzle 29 for the air to blow down the tobacco into the feed tube 4, a timing sequence, illustrated in FIGS. 11 to 11*c*, is used. This timing mechanism will be explained in conjunction with FIGS. 11*a* to 11*c*. A stirrer is identified as 31 and the stir rod as 31*a*. The stir paddle 31*b* lies close over the feed wheel 27 and at a right angle thereto.

Inasmuch as tobacco in finely cut form tends to agglomerate and/or coalesce, a vibrator and/or a stirrer helps to fill the emptied holes 28 as these are moved into the fill position underneath the hopper 25 for filling with tobacco therein.

However, the hopper unit 12 needs to be disassembled from time to time to assure its proper functioning, and for that purpose a latch arm 33 holds down the hopper 25 when engaged to a latch arm bracket 34, such as by a latch pin or bolt 35, or other means further shown herein. Opposite the latch arm 33 is a hopper holder 36 containing a hinge 37. The hinge 37 is mounted on a hinge bracket 38. As shown in FIGS. 7 and 8, when adding tobacco in the hopper 25, the hopper lid 25*a* is lifted and tobacco is introduced. A larger hold-up tank (not shown) may also be placed over the hopper 25 to feed the hopper on an almost continuous basis.

The feed wheel 27 rests in a feed wheel dish 39 which has a bottom plate 40 upon which the feed wheel 27 rests on an O-ring 27*a*. This arrangement is further shown in FIG. 6. As mentioned before, the feed wheel 27 is rotated in a continuous manner to align transitorily and rotationally each of the holes with the pneumatically operated feed nozzle 29, and in the instant of alignment the tobacco is blown down by the feed nozzle 29. The timing means to achieve the proper pulse duration and the advance or retard mechanism has been shown in FIGS. 11*a* to 11*c*.

Figure 2:
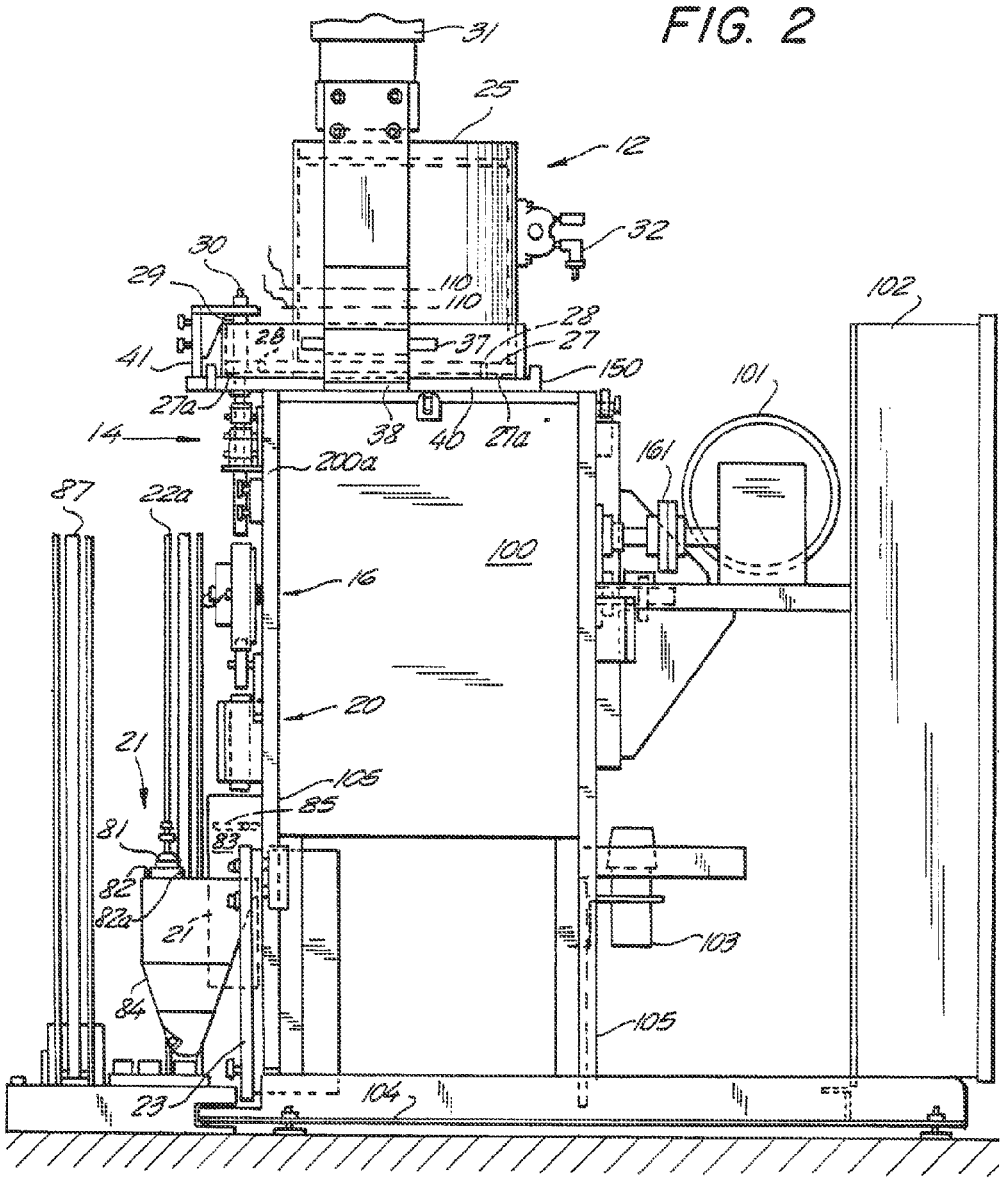
FIG. 2 illustrates, in part schematically, the right aide view of the machine shown in FIG. 1.

A mounting bracket 41 for the feed nozzle 29 allows alignment and removal of the feed nozzle 29 before the hopper unit 12 is removed to provide access to the feed wheel 27. A side view in FIG. 2 illustrates feed nozzle 29 in more detail.

Turning now to the paper tube 5 forming unit 14, it consists of an arm 43 holding a roll 44 of paper tape 6. Tape 6 is guided around guide rollers 46 over a smoothing plate 46*a* into a tube forming die 47 which folds the paper tape 6 around the fill tube shown in FIG. 1*a* as 4, and achieves thereby a tube form 5. The die 47 and the paper tube folding are illustrated in FIGS. 10*a* and 10*b*. As seen in FIG. 10*b*, the overfold of the tape 6 edges is achieved by the two plates 47*a* and 47*b* with the tube formation achieved in a continuous manner by this arrangement and by the positive pull on the paper tube 5 as it is being filled. A squeeze collet 48 holds the fill tube 4 in a rigid position and has a slight funnel shape in it. An upwash from the pneumatic air employed to inject tobacco 3 into the tube 5 requires that the phenomenon be compensated by the injected air pressure or by injected air pulse duration. Air injected in the paper tube 5 bleeds out of the permeable paper tube. The paper tape 6 is typically the same paper as used for making tea bags and is freely available on the market.

The formed paper tube 5 surrounds the filler tube 4 circumferentially thereof. Die 47 is supported independently of the tube by lug 49 protruding perpendicularly from bracket plate 50. Bracket plate 50 also holds the guide rollers 46, as well as the guide plate 46*a*.

In order to form a longitudinal seal along the formed tube 5, heating unit 15 is used therefor. It is shown in FIG. 1 in a disengaged position before a full temperature build-up is achieved in sealing die 51. Sealing die 51 is a concavely shaped die 51 sealingly and progressively more tightly engaging the paper tube 5 along the longitudinal overfold of the paper tape 6. An angle of about one degree or less has been found to be sufficient to achieve the heating and sealing function, as the die 51 bears very lightly against the unsealed paper tube 5 and presses at the bottom part lightly against the filler tube 4. Sealing die 51 extends slightly, e.g., ¼ inch and more, e.g., ½ beyond the end of tube 4. Filler tube 4 must be very smooth so that the paper does not tear. The concavely formed sealing die 51, which is also very smooth, is heated by a heating element of the resistance type 52*a*; thermocouple 52 monitors temperature for heating die 51.

Gross heating is accomplished by heating unit 52*a*, and the fine heat adjustments of it are controlled by a variable voltage resistance heating while a fine heat adjustment through resistance unit 52*a* is controlled by a phase fired temperature controller (not shown).

An insulation layer 53 insulates the sealing die 51 from the rest of the machine.

Upon a stop or interruption during the machine operation, the in and out adjustments of die 51 are made by means of an air cylinder 56, as otherwise the paper tube 5 will be burned or charred by the sealing die 51. However, the main function of air cylinder 56 is a gross adjustment, i.e., disengagement of the heating die 51 by retraction of it as shown in FIG. 1 in the retract position. To accommodate heat expansion, a slight spring bias of sealing die 51 is provided for by a spring 54 biasing, the sealing die 51 in a positive manner against paper tube 5. Retraction of die 51 occurs whenever during the production cycle of the chain of pouches a condition occurs which requires that production be interrupted or the machine be stopped.

These control feature interconnections will be further discussed herein.

The air cylinder 56 which drives the heating unit is supported on a bracket 57 while the heating unit rides on two rails 58, one each at the bottom and top supporting the heating die 51, its insulating elements 53 and the support unit 56*a*.

Opposite the heating unit and bearing against the filler tube 4 are concavely shaped rollers 59, two of which are shown. These rollers 59 hold the formed paper tube 5 against the filler tube 4.

As shown in FIG. 1*a*, the paper tube 5 has been end sealed at a band 7. This seal corresponds to the position shown in FIG. 1 by the engaged heated sprockets 60 on sprocket wheel 61. The pouch 9 and its transverse seals 7 and 8, respectively, form one link in a chain. Seals 7 and 8 are formed in the pouch forming unit 16 which consists of a heated sprocket wheel 60 which upon rotating engages the elastomerically conforming sprockets 62*a* of wheel 62. Sprockets 62*a* may be made of a high temperature resistant elastomer, e.g., silicone rubber. By this engagement of the sprocket wheels 61 and 62, the paper tape 5 is positively pulled and seals 7 and 8 are formed with sufficient time between seal formation due to continuous rotation of sprocket wheels 61 and 62 for the tobacco injection to take place. This achieves the filling of the pouch 9, and yet substantially without an upwash of the tobacco during the filling. Unacceptable upwash would capture tobacco in the seal. The sprockets 60 on wheel 61 are heated by a resistance heater, and thus cause the formation of the seal 7.

Both of the sprocket wheels 61 and 62 may be heated, or only one may be heated depending on the relative resistance of the paper to the sealing means and the relative speed thereof. It has been found adequate if only one of the sprocket wheels, namely—61, is being heated, although it is contemplated that both may be heated if necessary. The resistance elements are inserted in each of the sprockets 60 through electrical connection 63, shown for wheel 61. The actual interconnection is through a commutation, e.g., as shown for the thermocouple in FIG. 11. Further, the heating may be through a resistance heater (not shown) mounted on the face panel of the machine 200*a*, and the heating is by convection through a very small gap, e.g., 0.01 inch or less, the heater conforming to the wheel and being in an annular shape.

As the seal 7 is being formed and as a feed wheel 27 and hole 20 are appropriately aligned with the feed tube 4, air via the pneumatic line 30 and the feed nozzle 29 makes a brief swirling air jet at a pressure of about 60 psi for a pulse cycle of 20-100 milliseconds or longer into feed hole 28. This jet pulse causes the tobacco to travel all the way down the feed tube 4 into the space up to the two engaging sprockets on wheels 61 and 62, forming the seal 7. As the timing of the injection and capture as well as backwash has been allowed for in the speed of the sprocket wheel 61 and 62 and as soon as the filling operation is concluded, the next set of sprockets on wheels 61 and 62, respectively, engage each other and seal the upper part of the pouch or packet, completing the formation of seals 8 and 7, as shown in FIG. 1*a*.

The paper tube 5 is thus converted into individual pouches in a continuous flow, although the tobacco is injected in a step and index manner, even though the feed wheel 27 rotates continuously. A chain consisting of pouches 9 is taken off the sprocket wheels and guided leftwardly by the guide unit 17 consisting of an elastomeric material covered wheel 64. One of the elastomeric sprockets 62*a* on wheel 62 grips the pouch at seal, e.g., 7 or 8, and engages also the elastomeric guide wheel 64, thus again positively pulling the chain of pouches. Wheel 64 is free wheeling, and is supported on bracket 65. As the individual pouches 9 are guided around a guide roller 67, these are led onto a hold-down belt 60 positively driven by the arrangement shown in FIGS. 10*c* and 10*d*.

As shown in FIG. 10*c*, each of the two wheels 69 and 70, one on each side of belt 68, 69 has an elastomeric peripheral surface rim 69*a*. Rim 69*a*, in turn, is frictionally engaged by two elastomeric peripheral surface rims 68*a*, one on each side of the anvil wheel 72 which drives the corresponding surface rims 69*a*. This arrangement, which increases the peripheral circumference of the wheel 72 by the elastomeric rim 68*a* circumference, thus causes the belt 68 to travel slightly faster than the chain of pouches nestled between rims 68*a* where the circumferential distance is slightly less. Appropriately sizing rims 69*a* and the rims 68*a*, belt 68 may be made to travel at a sufficiently higher rate such that the chain of pouches is at all times under a positive tension and is properly fed into the engagement for precise cutting of the seal 7 and 8 in the formation of the individual pouches. Thus belt 68 pulls the chain formed of the individual pouches 9 slightly more than the peripheral speed of the anvil wheel 72. Belt 68 travels around two wheels 69 and 70, respectively. Wheel 70 may also more positively engage the chain of pouches 9 if a weight 69*b* (not shown in FIG. 1, but shown in FIG. 10*c*) is attached thereto. Wheel 69 axis 69*c* also serve as a pivot point for disengaging belt 68 from the chain of pouches.

As shown in greater detail in FIG. 10*c* (but not in FIG. 1), the adjustment screw 300 serves to raise and lower the guide wheel 67 around pivot point 301 for guide wheel 67. If guide wheel 67 is raised, the end seal has to travel a lesser distance between 67 and around anvil wheel 72 before the knives cut the end seal 7 or 8. If guide wheel 67 is lowered, the previously mentioned distance is increased. Accordingly, a desired midpoint cut in end seal 7 may be achieved by positioning upwardly or downwardly guide wheel 67. An opening 303 in the guide wedge 302 allows the photocell 18 and light lea to spot any empty bags or any chain interruptions.

In the next section designated as 20, each of the pouches is fed in a cutting section, previously identified as 20. This cutting section consists of a cutting wheel 71 and an anvil wheel 72. These wheels are in a different speed relation to each other, and the cutting wheel 71 rotates three times faster than the anvil wheel 72. There are three knives 304 (not shown in FIG. 1, but shown in FIG. 10*c*) on the cutting wheel 71 which are mounted at an angle, typically 3°, ouch that these knives impart a slight shearing action against the anvil 305 set at about one degree angle (not shown in FIG. 1, but shown in FIG. 10*c*), severing precisely each of the pouches in the fused joint 7 and 8 so as to form an individual pouch from each of the links in the chain consisting of the joined together pouches 9, now cleanly severed.

Each of the wheels in 71 and 72 rotates on its corresponding axis 71*a* and 72*a*. The wheels are faced off with a plate 73. Plate 73 has two pneumatic inlets, 71*b* and 72*b*, respectively, communicating with passageways 306 (not shown in FIG. 1, but shown in FIG. 10*c*) in each of the wheels 71 and 72, respectively, which exit on the peripheral outer face of wheels 71 and 72. The purpose of these passageways connecting the side face of the wheel to the outside rim of the wheel is to allow a jet of air to keep the severed pouches from being rotated with the wheels 71 or 72, respectively, and to pull down to the right of gate 307 which extends for the width of wheel 71 as shown in FIG. 10*c*.

As the wheels are rotating relative to each other and a slight shearing action is imparted due to the alignment of the knives 304 on the cutting wheel 71 relative to the anvils 305 (also shown in FIG. 10C), a clean and precise, severance is achieved of each pouch. The anvils 305 are supported by a support 309. Although an impact or a straight knife cutting (not shown) upon an anvil has also been used for the cutting of a pouch, the shear action cutting is preferred. However, the previously discussed method may work equally well and has been found to function adequately, but the reliable performance is not as outstanding as that found for the shear action imparting cutting wheel 71 previously described above.

As the pouches fall into the receptacle 21*a* and filling device 21, these are accumulated in sufficient number to fill a container 10. After the filling has occurred, however, a jet of moisture is added to the pouches 9 in a can 10 so that these may be of the right moisture accepted by the consumers as necessary for the enjoyment of smokeless tobacco.

Turning now to FIG. 2 as shown in side view, bracket 36 holds the tobacco hopper 25 in such a manner that the hinge 37 allows the hopper to be removed from the feed wheel 27. Feed wheel 27 shows teed holes 28 in phantom lines.

The vibrator 32 and the stirrer 31 and its stir paddle 31*b* assure that each of the feed holes 20 on the periphery of the feed wheel 27 are being filled as these rotate within the hopper section overlying the feed wheel 27.

The feed nozzle 29 as mentioned before imparts a swirling motion to the tobacco in each of the peripheral holes 28, and this drives the tobacco into the feed tube 4 and the wrapped around tube 5 formed of paper tape 6.

The drive arrangement for the various sections such as the sprocket wheel 60 and 61 and the interrelated control of the feed nozzle 29, and the continuous drive for the feed wheel are housed in the housing 100 and are illustrated in FIG. 12 and will be further described herein.

The main drive motor is shown in FIG. 2 as 101. The electronic or electrical control devices are housed in cabinet 102.

Shop air for connection to the various pneumatic devices is connected to a shop air connector 103.

The base of the machine, as shown in FIG. 2, has been identified as 104 with the legs 105 supporting the machine and attached to the base.

Further, with reference to FIG. 2, the actual operation of the moisturizer section 21 in conjunction with the fill section will be further explained herein, but the moisturizer valve has been shown as 81, the water inlet therefor being 82, and the air inlet therefor as 82*a*. In FIG. 1, the chute 83 feeding the feed hood 84 has been shown both in front view and side view, respectively. In operation, an appropriate accumulator gate 85, activated by a two-way pneumatic cylinder 86 in normal operation of the machine works is follows. While a previous can has been filled and is being indexed to the next position for eventual placement of a lid thereon, the accumulator gate 85 swings upwardly and receives the next batch of severed pouches 9. As soon as the indexing operation is completed, the partially accumulated pouches, held by the accumulator gate 85, are dropped. That is, the accumulator gate 85 is lowered and the pouches fall into the next can. The accumulator gate 85 is kept down as long as the necessary count for package 10 is accomplished by the machine. As soon as the count is complete, the accumulator gate 85 moves upwardly, again activated by cylinder 86, and accumulates, partially, the contents for the next can. The water jet unit 21, through the water inlet 82 and air inlet 82*a* therefor, injects an appropriate amount of moisture into the can. After completion of that operation, the can is then indexed again to the next position. Meanwhile, the accumulator gate 85 has accumulated a number of bags 9 again, allowing again the indexing of the next can, the filling and moisturizing of it and so forth.

The can feed section comprises two chutes 22*a* and 67, the first feeding the cans and the second feeding the lids to be placed on the cans. In greater detail these are shown in the subsequent drawing, namely—FIGS. 3, 4, 4*a* and 4*b*. The schematic of the pneumatically controlled sequence and the operating procedure has been shown in FIGS. 12 and 13, respectively.

In FIG. 2, a low tobacco indicator has been illustrated which may be a resistance-measuring probe and is shown as 110 and 111, respectively, including the lead lines therefor.

Figure 3:
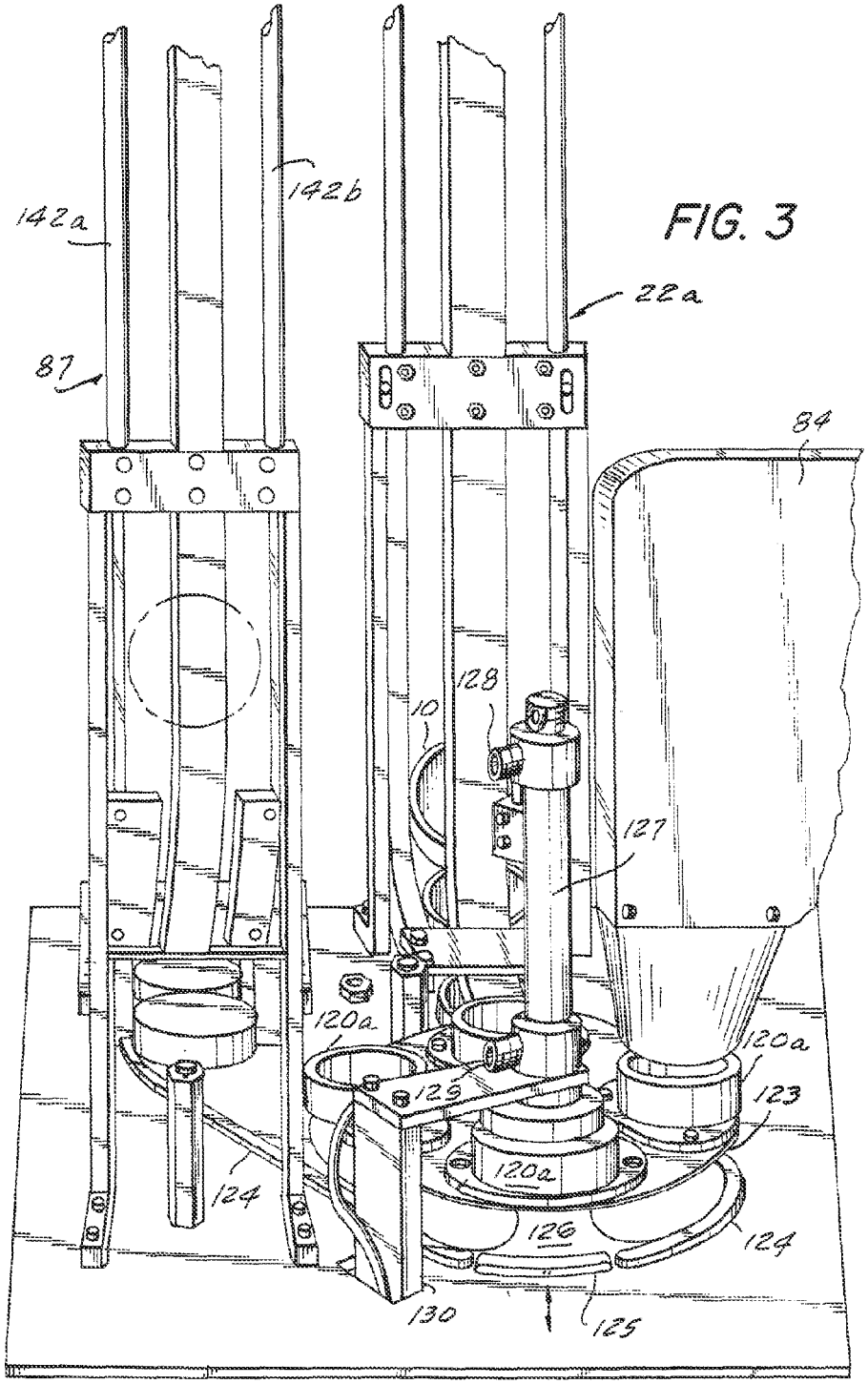
FIG. 3 illustrates in a perspective view the container, i.e., can, filling machine.

Turning now to FIG. 3, it shows in greater detail the packaging unit 22. The pouch filler chute is 84. The vertical can chute is shown as 22*a*. In turn, the vertical lid chute is shown as 87. In filling the cans, these are placed in the indexed filler unit designated as 22 in FIG. 1 on top of the top plate which is shown as 120. Over the top plate 120, index wheel 123 carries four filler collars 120*a* in the four positions as shown. The top plate 120 underlies the cans 10 which are being fed by gravity downwardly in can chute 22*a*. This chute is of the conventional type and need not be discussed in greater detail.

As the cans enter one of the four positions provided for in the index wheel 123, these are being indexed through four positions. The four positions in the indexed wheel 123 are as follows. The "Can receive" position is No. 1; the "fill position" is No. 2; the "tamp position" is No. 3, and the "eject position" is No. 4. Upon filling the can with an appropriate count of packets or pouches 9, the water inject unit shown in FIG. 2 as 21 is activated. An appropriate amount of water is then added to maintain the moisture content of the smokeless tobacco. Water tends to equalize rather readily in the packaged can so it is not necessary to have it immediately evenly dispersed.

After the fill position, in the tamp position a pneumatically activated tamper cylinder 127, having a downward stroke activation as well as an upward stroke activation, represented by pneumatic inlets 128 and 129, is used to assure that the package is tightly packed.

Thus the can 10 is prepared for placement of a lid thereon. In the event that a can contains an improper count of pouches, i.e., the photoelectric eye and cell combination 18 and 18*a* has detected an unfilled bag or pouch, the sequence allows an entire can to be rejected. It has been found more easily to deal with the problem by rejecting a can rather than rejecting an individual pouch.

For this reason, a reject opening 126 under the tamper cylinder 127 in the index wheel shown as 123 is used. A can which contains an improper count is indexed to the third position, under tamper cylinder 127, then gate 125 is lowered by a pneumatically activated gate cylinder 125*a*, and a blast of air (from a nozzle shown in FIGS. 4 and 12 as 140) thrusts the can outwardly through space 126 and over the lowered gate 125, the gate 125 having been previously properly positioned for the rejection of that particular can.

The gate 125 is part of the fence 124 guiding the properly filled can into the lidder or lid applying unit, further shown in FIGS. 4 and 4*a*. Again, the index wheel 123 has an appropriate cam action which allows the filled can 10 to be guided along the guide fence 124. The tamper cylinder 127 is supported by a bracket 130. This bracket may also be made conveniently in such a manner as to swing out of the way for removal of the cover plate 120 and index wheel 123 therefor.

The lid or lidder unit shown in FIGS. 4 and 4*a* operates as follows. AS the cans are moved by index wheel 123, the cans fall in a half round slot 180 of approximately the same size as the can. The half round slot 180 is in plate 138. Plate 138 is held by the bottom slide plate 138*a*. Pneumatically driven can feeder cylinder 135 linked to the plate by pin 136 and blade 136*a* in a longitudinal slot 181 in the middle of the half round slot 100 pushes the captured can 10 between two edges 146 such that the can lid 11 is held down by spring 142 riding on a left-hand and right-hand side rails 142*a* and 142*b*, respectively, shown in FIGS. 3, 4*a* and 4*b*. The lid 11 is engaged by the can 10 at the left forward most point. Plate 138 keeps moving the can 10 forwardly to the left in FIG. 4 and opens the detent fingers 147 which pivot at points 146*a*, and are retarded by springs 147*b* and stopped by stops 147*a*. Leaf spring 142 is held down at 148. Leaf spring 142 holds down the lid 11 on the rails 142*a* and 142*b*. A heavy wheel 144 pivoted at 142*a* and free wheeling at 143 (having a groove of the diameter of the can and shown in phantom lines in FIG. 4) cams down the lid 11 on can 10 upon the further plate 138 travel. Plate 130, upon completion of the stroke, ejects the can past the wheel restrained by adjustable bolt 145 from engaging the can 10 any more than necessary to complete the lid 11 placement.

FIG. 5 illustrates the bottom part of the filler wheel 27 with the filler holes 28. Altogether 18 holes have been shown. While the size of the holes can be increased to achieve greater density of tobacco in each of the individual pouches 9, the size of the pouches stays essentially the same. Although with appropriate modifications in the wheel diameter of the pouch forming wheel, namely—the sprocket wheels 61 and 62 and cutting wheel 71 and anvil wheel 72, the pouch size could also be varied; it requires a major modification of the machine.

These substantial modifications, while contemplated, indicate that once the machine has been set up, it tends to operate essentially with the same size of pouch being produced. The distinction, however, from the prior art resides in that the pouches, of extremely uniform size, can be formed and cut very uniformly at a predictable place on the end seals, e.g., 7 and 8. There is substantially no tobacco in the end seals, e.g., 7 and 8, thus preventing pouch failure due to lack of seal formation.

The groove for the O-ring 27*a* has also been shown in the Figure and identified as 27*b*. As this is the bottom view of the filler wheel 27, it is clear that tobacco, while it will escape somewhat sideways towards the central portion of the drive shaft key way 28*a*, will not be allowed to go to the periphery of the wheel.

If necessary, two grooves may be provided on either side of the holes 28 with appropriately sized O-rings placed therein.

In FIG. 6, the filler wheel 27 has been illustrated in more detail. The bottom plate 40 has a circumferential rim 150 while the filler wheel has a shroud rim 39. The hopper 25 fits over the filler wheel 27 inside the shroud rim 39 and thus keeps the fine tobacco from escaping except into the holes 28.

Nevertheless, it has been found in practice that it is necessary to remove the hopper 25 every day. For that purpose, hinge 37 and hopper 25 removal is necessary so that the feed wheel 27 can be cleaned. In addition, it has been found necessary that the Stainless steel filler wheel 27 be removed and cleaned on a regular basis. Thus FIG. 6 illustrates the hinge arrangement with a hinge 37 shown in connection with the bracket 38, as well as the hopper support 36.

Turning now to FIG. 7, it illustrates in a top view the hopper 25 with the lid thereof 25*a* made of Plexiglass. A piano hinge 151 allows the opening of the hopper and the filling of it. The lid is anchored to the hopper 25 by a suitable fastening means identified in FIGS. 7 and 8 as 152 and 153. A latch 33 shown in FIG. 10 is conveniently fastened to latch post 34 by tightening thumb screws 33*a*. The hopper has a segment which is very shallow and is depicted by the Plexiglass cover 30*a* which is loosely affixed to the hopper 25 and rides on the rim 39. The segmented portion 30*a* of the hopper 25, as shown by the Plexiglass cover, facilitates the access to and mounting of the feed nozzle 29.

With reference to FIG. 11, it illustrates a schematic drive train for the machine shown in FIG. 1. In FIG. 2, the motor has been previously identified as 101. Typically it is a ½ horsepower, direct current motor such as rotating at 1750 rpm. A 50 to 1 reduction transmission has been identified as 160. A torque limit clutch is shown as 161. A bearing support bracket has been identified as 161*a*. Other bearings are appropriately supported, and all shafts are appropriately provided with supports. The main drive shaft drives a spur gear 162 which engages the complementary spur gear 163 on drive shaft 163*a*. Sprocket wheel 62, shown in FIG. 1, in driven by the takeoff gear 164 which is interconnected with the shaft driven by complementary spur gear 163 and the counterpart spur gear 165.

A bearing support 169 carries the drive shaft 169*a* forwardly and interconnects the same with the means for driving the feed wheel 27, namely—bevelled gear pair 170 and 171, respectively. A bearing support 174 allows the shaft 173 to drive the feed wheel 27 through a bearing-journal arrangement 174*a* in such a manner that the interrelated continuous motion is smoothly transmitted to the feed wheel 27. The upper end of the drive shaft 173 fits into the feed wheel 27 drive slot key 28*a*. The shaft 163*a* also carries a star wheel 172. Star wheel 172 is used for timing the air injection in the feed nozzle 29 which feeds the tobacco portion 3 into the filler tube 4, as shown in FIG. 1*a*. The details for the feed nozzle 29 air pulse length adjustment and the pulse retard and advance mechanism are shown in FIGS. 11*a*, 11*b* and 11*c*. Shaft 163*a* also carries on it a sprocket wheel 166 and a sprocket chain 166*a*. The chain 166*a* drives the cutter wheel 71 and anvil wheel 72. Sprocket chain 166*a* has a sprocket chain follower wheel 168 to impart the desirable tension on the chain 166*a* and assure positive engagement.

The sprocket gear 167 and spur gears 175 have appropriate synchronizing and alignment hubs identified as 176. In order to facilitate the sharpening of the knives in wheel 71 and its removal from the machine, the entire cutting wheel 71 and anvil wheel assembly identified in FIG. 1, as 20 may be removed with a frame 177. Further, the cutters wheel 71 may be disengaged from the anvil wheel 72 by disengaging gears 175. In the disengaged portion, a hand wheel 176 effects necessary knife alignment with the anvil wheel 72 and allows the adjustment, e.g., after knife sharpening, etc.

A commutator 178 for a thermocouple inserted in the heated sprocket wheel 61 has also been shown in FIG. 11. A commutator of the same type may be used when heating a resistance unit for the heated sprocket wheel 61. Other equivalent current transfer means through a rotating shaft are mercury switches, and these are available in the art.

Although in FIG. 11 the cutter wheels 71 and its complimentary anvil wheel 72 has been shown in a one to one gear ratio, the speed ratio may be varied to 3:1, etc. As previously mentioned, the cutter wheel 71 has been found to be preferably and advantageously in a 3:1 speed ratio (peripheral speed) for the anvil wheel 72.

Turning now to FIG. 12, it illustrates schematically the pneumatic system used for the operation of the machine. A pressure gauge 200, also shown in FIG. 1, indicates the pressure for the filler nozzle 29. The air pressure is adjusted to suit the filling conditions. If the air pressure is unduly low, the tobacco is not properly filled in a pouch. Filler nozzle 29 is timed and operated by a solenoid 201.

The air cylinder 56 which operates the edge sealing or longitudinal seal die 51 retracts the die whenever the machine is stopped. As shown in FIG. 1, the die is in the retract position. Instead of an air operated or pneumatically operated motor 56, the same may also be replaced by an appropriately electrically operated motor.

Air cylinder 56 is operated by an activated solenoid valve 203 whenever a failure or stop mode occurs.

In the production cycle the next event which occurs is the proper cutting of the bags in the cutting unit 20 shown in FIG. 1 by the cutting knife 71 and the anvil wheel 72. Pneumatic inlets in the face plate 71*b* and 72*b* are shown schematically in FIGS. 12 as 71*b* and 72*b*. These units are on continuously and are only shut off by the solenoid valve 201*a* when the machine is stopped.

Next, the pneumatic cylinder 86 for accumulator gate 85, shown in FIG. 1, is operated by the cylinder in FIG. 12 identified with the corresponding number 96. The operation of it has been previously explained. Again, this unit is solenoid operated such as by the solenoid 203 shown in the schematic diagram.

The packaging unit for packaging can 10 with the individual pouches has an index cylinder 123*a* which, in turn, indexes upon completion of the proper count of each of the containers. The index cylinder 123*a* is a one way ratchet cylinder. Thereafter, the tamper cylinder 127 shown in FIG. 3 tamps the contents. If a particular count is inadequate in a can or an interruption has occurred, the index wheel 123 position is sensed as a 'fill' or "no fill" position by a cam and follower or other equivalent means. If a can needs to be rejected, or if the photoelectric eye and lamp combination 18*a* and 18 detects an empty bag or improperly filled bag, after properly counting and identifying in which can the empty bag will fall, i.e., depending where the occurrence of the failure has been established, the can is rejected by operating the reject gate 125 by means of the reject gate cylinder 125*a* in combination with the air reject jet shown as 140 in FIG. 12. Counting circuits are well known in the art and can be readily interconnected with the photocell and light 18 and 18*a* and the can reject gate cylinder 125 and air jet 140 solenoid valves.

When a lid is placed on the can as shown in FIGS. 3 and 4, a pneumatically operated cylinder 135 accomplishes that function in the manner as previously explained.

The above explains the sequence of the operation of the machine from the point of view of the pneumatic circuit. These circuit elements, e.g., cylinders, air jets, etc., in turn are interconnected with the electrical control unite which operate the appropriate solenoids. If necessary, of course, some of the units may be operated intermittently or continuously, such as vibrator 32 in combination with the hopper 25.

Turning now to the star wheel identified as 172 and its associated feed nozzle 29 timing and pulse manipulation, these are shown in FIGS. 11*a* to 11*c*. The star wheel has a number of progressively tapered teeth 172*a*. The proximity sensor 400 mounted crosswise on the proximity sensor arm 401, shown for the sensing mechanism 402, is capable of sensing the initial presence and the passing of the star wheel tooth 172*a*, i.e., the total duration of the passage. By extending the arm 401 by the screw 403 adjustment, the sleeved block 404, riding on rod 405 allows the change in the duration of the air admitted to feed nozzle 29. A pulse is thus shortened with reference to a datum point. In turn, by retracting the arm, the duration of air admitted to feed nozzle 29, i.e., a pulse is increased in length as the proximity sensor 400 sees more of the metal in the star wheel 172 for a longer time.

If the proximity sensor housing plate 406 is pivoted about pivot point 407 and adjusted with a set screw 408, the datum plane is such that either the proximity sensor detects the metal earlier or later and thus the feed nozzle 29 pulse is either advanced or retarded. This fine adjustment allows the precise timing of the pulse for the feed nozzle 29, as well as the duration therefor. Hence, the proper filling of the tube 5 is on a continuously moving basis. After the end seal of 7 is formed, filler nozzle 29 fills the tube 5, and before the elastomeric pad on sprocket wheel 62 positively pulls the end seal 7 to form a seal 8, the precise filler nozzle timing and duration must take place. The proximity sensor 400 is interconnected to the feed nozzle 29 through an appropriate circuit and operates the solenoid valve 201 shown in FIG. 12.

If one remembers that at top speed from six to eight bags per second are being formed, one can appreciate the advantages of the continuous bag formation rather than the step and index prior art approach where production rates of about less than half of those achievable herein are only possible.

Turning now to FIG. 13, it explains the machine operation and the sequence of steps by which an operator controls the quality indicated by the quality control features on this machine. The legends on the block diagram are self-explanatory.

As shown in FIG. 13 reading from left to right, the box diagram explains in detail the steps necessary, first to activate the machine and then to start it. As part of the procedure, the last can that is in the machine in the fill mode is always rejected.

The rest of the sequence has been previously explained in combination with the machine operation and need not be elaborated. Electronic circuitry necessary for the operation of the machine is of the conventional type; circuits and their components for the above explained controls or steps are available.

With respect to the temperature control unite, these are normally operated as any conventional resistance heating units. The temperatures that have been found to be acceptable for the heater, such as side seal heater 51, vary based on the paper used, and have been selected accordingly as measured with a pyrometer. The end seal, e.g., 7 or 8, is achieved by sprocket 60 at a temperature found sufficient as measured with a pyrometer on one edge of one of the stainless steel heater sprockets 60.

Although the temperature reading may be higher with respect to the wheel holding these sprockets, the ultimate temperature determination and workability of the end seals or transverse seals is dictated by the quality of the formed seal itself.

In general, the air which has been used for operation of the pneumatic lines is about 40 to 60 psi. The pressure for the feed nozzle 29 has been found to be in the vicinity of 60 psi. However, the air pressure on the face of the cutting wheel 71 has been found to be adequate if set at about 10 psi.

The pneumatic cylinders are generally operated at a pressure of about 85 psi, but various adjustments may be made as needed depending on the cycling of the machine, etc.

The above-described machine, as illustrated in the embodiments shown above, has achieved high production rates such as from six to eight pouches per second. This rate has been accomplished by the continuous bag filling operation, and yet at the same time overcoming the rate limiting step and index operations. The result has been very precise and facile production of a tobacco-filled packet. The advantages in the present packet or pouch itself reside in the fact that the seals are exceptionally tobacco frees the filling is very precise as the fill wheel is operated under very high rates of production and precision; the cutting of the end seals is accomplished with adjustable precision such that the cut is repeatedly precisely made and the integrity of the bag is maintained. Fine adjustments in the cut can be accomplished with the device as illustrated herein so that the seals are at all times unaffected by the cut. The shearing action in the cutting wheels such as wheel 71 has a very beneficial function, because the cut is precise, positive and cleans the knives are self-sharpening to a certain extent, and the rapid cut allows a positive severance of the bags. This is more difficult to accomplish with a knife and anvil system which, furthermore, requires repeated sharpening. Moreover, the shear action also eliminates shock loading of the system and thus interruption is lees likely to occur. The bag count is made by a combination of the photocell 18 and light 18*a* as well as the anvil wheel 71 rotation, as the number of bags between the photoelectric eye and the 9 o'clock cutting position does not change.

Furthermore, by appropriately providing for a proper count and knowing where an improperly filled bag or can is located, the quality control can be assured by automatically rejecting the undesired pouch with the entire can. The precise count also avoids the empty box or empty bag problem, and the inspection of each of the machine-made pouches assures that there are no empty bags in one of the packages.

What is claimed is:

1. Apparatus for producing packets of a flowable material, each of which packets comprises a quantity of said flowable material enclosed within a layer of sheet material, the combination of: fixed means forming a passageway for said flowable material which extends to a discharge opening, means to deliver a series of quantities of said flowable material into said fixed means, said fixed means having an outside surface configuration which is adapted to guide a strip of said sheet material into a tube which has a cross-section area of substantially the cross-section area of each of said packets with the edges of said strip overlapping, means to move a strip of said sheet material onto and thence through said fixed means at a substantially even rate, means to seal said edges of said strip together above the level of said discharge opening thereby to form a filling zone within which said series of said quantities of said flowable material are discharged in a time-separated series into said tube immediately after said tube is formed and means to cross-seal said tube in a predetermined manner away from said discharge opening whereby said tube is adapted to receive each of said quantities of said flowable material enclosed in said tube between two successive cross-sealed portions of said tube.

2. The construction as described in claim 1, wherein said sheet material is heat-sealable and said means to cross-seal comprises two sprocket wheels, which sprockets have flat surfaces which engage the opposite sides of said tube in the area of each cross-seal, with a heated sprocket and another sprocket on a second wheel presenting opposing surfaces which press said tube together to form each cross-seal.

3. The construction described in claim 1, wherein said means to deliver comprises a rotary feed wheel including pockets and wherein said pockets are cylindrical holes spaced the same radius from an axis of said feed wheel, and jet means positioned in axial alignment with said passageway and operative to project a jet through each of said pockets and thence through said passageway into said tube and to insure a delivery of each of said quantities into said tube.

4. The apparatus of claim 1, further comprising a cutting unit positioned below said means to cross-seal, the cutting unit comprising a cutting wheel that rotates relative to said fixed means at a rate to cut said cross-sealed portions of said tube and produce six to eight packets per second.

5. The apparatus of claim 3, further comprising a cutting unit spaced apart and positioned below said means to cross-seal, the cutting unit comprising a cutting wheel that rotates relative to said fixed means at a rate to cut said cross-sealed portions of said tube and produce six to eight packets per second.

6. An apparatus for producing packets of a flowable material, each of the packets comprises a quantity of said flowable material enclosed within a layer of heat-sealable sheet material, the apparatus comprising: a fixed tubular structure forming a passageway for said flowable material which extends to a discharge opening, a movable feeder structure that moves in a continuous manner relative to said fixed tubular structure to deliver a series of quantities of said flowable material into said fixed tubular structure, said fixed tubular structure having an outside surface configuration which is adapted to guide a strip of said heat-sealable sheet material being formed into a tube with edges of said strip overlapping, wherein said strip of said heat-sealable sheet material is moved onto said fixed tubular structure at a substantially even rate, a die structure to seal said edges of said strip together at a level above said discharge opening thereby to form a filling zone within which said series of said quantities of said flowable material are discharged through said fixed tubular structure in a time-separated series into said tube, a set of movable sealer surfaces to engage opposing sides of said tube to cross-seal said tube in a predetermined manner away from said discharge opening such that said tube is adapted to receive each of said quantities of said flowable material enclosed in said tube between two successive cross-sealed portions of said tube, and a cutting unit spaced below and movable relative to said set of movable sealer surfaces so as to cut said tube along said cross-sealed portions.

7. The apparatus of claim 6, further comprising a hopper positioned above the movable feeder structure and being adapted to receive a supply of said flowable material.

8. The apparatus of claim 6, further comprising a sensor positioned proximate to said movable feeder structure, the sensor being configured to detect a position of a moving structure indicative of an approaching alignment position between said movable feeder structure and said passageway of the said fixed tubular structure.

9. The apparatus of claim 6, further comprising a tube forming die retained in a rigid position relative to the fixed tubular structure, wherein the tube forming die folds said strip of said sheet material around said outside surface configuration of said fixed tubular structure.

10. The apparatus of claim 9, wherein the tube forming die is positioned around to said fixed tubular structure and is supported in the rigid position independently of said fixed tubular structure.

11. The apparatus of claim 6, wherein said set of movable sealer surfaces each rotate about a respective axis of rotation positioned below said fixed tubular structure, said set of movable sealer surfaces rotating relative to said fixed tubular structure to engage and positively pull on said tube so that said tube is converted into a chain of packets while said tube is continuously moved yet receives each of said quantities of said flowable material in an indexed manner.

12. The apparatus of claim 6, wherein the cutting unit comprises a cutting wheel that rotates relative to said movable sealer surfaces and relative to said fixed tubular structure at a rate to cut said cross-sealed portions of said tube and produce six to eight packets per second.

13. The apparatus of claim 6, further comprising a main drive motor coupled with a transmission to drive movements of said feeder structure and said set of movable sealer surfaces.

* * * * *

UNITED STATES PATENT AND TRADEMARK OFFICE

CERTIFICATE OF CORRECTION

PATENT NO. : 8,757,167 B1
APPLICATION NO. : 07/084329
DATED : June 24, 2014
INVENTOR(S) : Edward Jurczenia, Eugene H. Paules and Frank S. Nastro It is certified that error appears in the above-identified patent and that said Letters Patent is hereby corrected as shown below:

On the Title Page, Column 2, Line 3 Item (57) (Abstract), please delete "pocket" and insert -- packet --, thereof.

On the Title Page, Column 2, Line 4 Item (57) (Abstract), please delete "pockets" and insert -- packets --, thereof.

In the Claims

Column 13, Line 62 (Claim 3), please delete "pockets" and insert -- packets --, thereof.

Column 13, Line 65 (Claim 3), please delete "pockets" and insert -- packets --, thereof.

Signed and Sealed this
Seventh Day of October, 2014

Michelle K. Lee

Michelle K. Lee
*Deputy Director of the United States Patent and Trademark Office*